US006287433B1

(12) United States Patent
Sapozhnikova

(10) Patent No.: US 6,287,433 B1
(45) Date of Patent: Sep. 11, 2001

(54) INSOLUBLE TITANIUM-LEAD ANODE FOR SULFATE ELECTROLYTES

(76) Inventor: Alla Sapozhnikova, 190 Old Oak Dr., #259, Buffalo Grove, IL (US) 60089

( * ) Notice: Subject to any disclaimer, the term of this patent is extended or adjusted under 35 U.S.C. 154(b) by 0 days.

(21) Appl. No.: 09/570,703

(22) Filed: May 15, 2000

Related U.S. Application Data

(62) Division of application No. 09/300,359, filed on Apr. 26, 1999, now Pat. No. 6,129,822, which is a continuation of application No. 08/711,013, filed on Sep. 9, 1996, now abandoned.

(51) Int. Cl.[7] ..... C25B 11/04

(52) U.S. Cl. ..... 204/293; 148/269; 148/281; 419/2; 419/27; 419/38; 419/46; 205/299; 204/281; 204/290.01

(58) Field of Search ..... 204/290.01, 293, 204/281; 205/292, 575, 576, 578, 299; 148/337, 243, 269, 281, 512, 513, 669, 421; 419/2, 27, 38, 46; 420/417; 427/77

(56) References Cited

U.S. PATENT DOCUMENTS 4,512,866 * 4/1985 Langley ..... 204/290.01
5,061,358 * 10/1991 Nobuyoshi et al. ..... 204/293
5,733,425 * 3/1998 Fang et al. ..... 204/293
6,129,822 * 10/2000 Ferdman ..... 204/288

* cited by examiner

*Primary Examiner*—Bruce F. Bell
(74) *Attorney, Agent, or Firm*—Niro, Scavone, Holler & Niro

(57) ABSTRACT

An insoluble anode for sulfate electrolytes composed of, generally, from 1 to 99 wt % titanium or titanium alloy and the remainder lead or lead alloy, comprising a titanium-lead active layer, or a titanium-lead active layer covering and a core being made from titanium or lead. The anode is produced by infiltration of porous titanium with lead, either by consolidation of the mixture of titanium and lead powders. The anode formed of the active layer, or of the active layer covering and a sheet core is fabricated in the shape of a plate. The anode formed of the active layer covering and a rod or tube core is fabricated in the shape of a lattice. Advantageously, the titanium-lead active layer is dispersion-strengthened by zirconium carbide or titanium carbide particles, and it's surface is released of a portion of lead.

27 Claims, 3 Drawing Sheets

INSOLUBLE TITANIUM-LEAD ANODE FOR SULFATE ELECTROLYTES

This appln is a Divisional of Ser. No. 09/300,359 filed Apr. 26, 1999 now U.S. Pat. No. 6,129,822 which is a continuation of Ser. No. 08/711,013 filed Sep. 9, 1996 abandoned.

BACKGROUND OF THE INVENTION—PRIOR ART

Anodes for Electrowinning of Metals

Electrowinning involves the recovery of a metal, usually from its ore, by dissolving a metallic compound in a suitable electrolyte and reducing it electrochemically through passage of a direct electric current. Increasingly more metals are being produced by electrowinning because of the stringent air pollution restraints on the more conventional concentrating, smelting and electrorefining processes.

Anode material suitable for electrowinning of metals has been a source of difficulty. The requirements are insolubility in the sulfate electrolytes, resistance to the mechanical and chemical effects of oxygen liberated on the anode surface, low oxygen overvoltage and resistance to breakage in handling.

At present, lead alloy anodes have been used in most plants for the electrowinning of metals such as copper, nickel, zinc, etc. A particular problem with lead anodes is prevention of lead transfer from the anode to the electrowon metal deposited on the cathode.

Copper electrowinning consists of using an aqueous solution of copper sulfate containing free sulfuric acid, electrolyzing it with an insoluble anode, and depositing its copper content as pure copper on the cathode. Oxygen is released at the anode. Copper electrowinning cells are open concrete tanks lined with plastic or rubber, approximately 1 meter (m) across, 1 m deep and 5–15 m long. Electrodes measuring about 1 m×1 m hang vertically at intervals of about 50 millimeters (mm). The electrodes are arranged so that they are alternately anodic and cathodic, and all anodes and cathodes in a single tank are usually connected in parallel. Copper is deposited on cathode starting sheets of pure copper, stainless steel, or titanium. The electrolyte contains from 25 to 40 grams per liter (g/L) of copper and from 100 to 160 g/L of sulfuric acid. Electrowinning of copper is carried out at current densities from 160 to 270 amperes per square meter ($A/m^2$) and electrolyte temperature 30–50 centigrade (° C.) (see Encyclopedia of materials science and engineering/edited by M. B. Bever.—Oxford: Cambridge, Mass.: Pergamon; MIT Press, 1986, pp. 1444–1445).

Conventional lead anodes for copper electrowinning are stabilized with antimony, calcium and/or tin, and by adding cobalt to the electrolyte, both of which inhibit electrocorrosion of lead. However, copper obtained by electrowinning using lead alloy anodes is not pure enough for wire drawing due to high lead content. The continued improvement of the anode material is critical to increase the life of the anode and the purity of the product, and to make electrowon copper suitable for most commercial uses.

Anodes for Electrolytic Manganese Dioxide Production

Electrolytic manganese dioxide (EMD) is manufactured at a large scale due to the remarkable electrochemical characteristic of EMD—its ability to function superbly as a solid-state oxygen electrode in dry-cell batteries.

EMD is produced by electrolyzing acidified manganese sulfate solution and depositing the product on the insoluble anode. Hydrogen is released at the anode.

The cells for EMD production are usually rectangular open steel troughs, lined with a corrosion-resistant nonconductive material. The electrodes measuring from about 1 m×1 m to 2 m×2 m are flat plates or series of cylindrical rods or tubes. The spacing between anode and cathode ranges from 25 to 50 mm. Cathodes are made from graphite, soft or hard lead, or stainless steel. The composition of electrolyte is maintained at about 80–150 g/L $MnSO_4$ and 50–100 g/L $H_2SO_4$. The electrolysis is conducted at an anode current density of about 70–120 $A/m^2$ and a temperature of 90–95° C. The process is terminated when the EMD layer deposited on the anode reaches a specific desired thickness. The product is stripped from the anode manually, or by an automated system. A number of continuous processes have been devised to generate the EMD as a precipitate at the bottom of the cell and to remove it without interruption of the electrolysis (see Encyclopedia of chemical technology/edited by H. F. Mark. New York: Wiley, 1984, pp.867–868).

The anodes are made mostly of graphite which tolerates high current densities without passivation. However, the gradual corrosive attack at operating conditions causes the excessive wear and the lowering of mechanical strength of graphite anodes. Anodes work for about 300 days before they break in the EMD-removal operation.

Lead, especially hard lead (with 3–8 weight percent (wt %) Sb), is also used as anode material for EMD production. At higher current densities lead contamination of the product takes place. More than 0.2 wt % Pb in EMD is undesirable because it shortens the lifetime of the batteries.

Considerable efforts to find practical titanium-based anodes and improve methods of their manufacturing to meet EMD industry's requirements are being continued.

Titanium-based Anodes

The excellent corrosion resistance of titanium in a variety of solutions and its self-oxidizing, valve-metal characteristic are recognized to be of value for electrochemical processes. With respect to mechanical stability, titanium also is the ideal anode material. However, as an anode in acid solutions, it does not pass current satisfactory because of the buildup of noncorrodible oxide coatings on the surface and passivation. By using titanium as a base metal, a series of composite anodes have been developed. To prevent formation of titanium oxide, the inert coatings on the titanium anode surface have been used. These anodes have been described as precious metal anodes (PMA), noble-metal-coated titanium (NMT), dimensionally stable anodes (DSA) and platinized titanium anodes (PTA). Noble metals and their oxides are used in the coating of titanium, in particular, ruthenium oxide, platinum oxide, platinum, platinum-iridium, which are deposited thermally or electrolytically on the titanium substrate. Several methods of applying coatings to titanium surface, using cobalt oxide, lead dioxide, manganese dioxide, mixed oxides and titanium carbide, have also been developed to improve performance of titanium anodes. All these anodes appear to have limited commercial use due to high cost and coating failure in the operating conditions of metal electrowinning and EMD production (See Encyclopedia of chemical technology/edited by H. F. Mark. New York: Wiley, 1984, pp.172–173).

Titanium-lead Anodes

Several U.S. patents relate to the anodes based on titanium-lead composite material.

U.S. Pat. No. 4,121,024, issued to Turillon et al. on Oct. 17, 1978, relates to a titanium-lead electrode for a lead-acid storage battery. The electrode is fabricated from a porous sintered metal which is lighter than lead, such as sintered titanium. This porous metal is then infiltrated with lead, a lead alloy, or by a metal wetted by pure lead. The electrode further includes a base with a protective layer of pure lead and a negative active battery mass adhered to the layer of pure lead.

The present invention does not relate to the use of the electrode for a lead-acid storage battery and does not include a protective layer of pure lead and a negative active battery mass adhered to the layer of pure lead.

U.S. Pat. No. 4,260,470, issued to Fisher on Apr. 7, 1981, relates to anodes for electrowinning of metals. The anodes are fabricated from a plurality of infiltrated sintered metal strips, such as sintered titanium infiltrated with lead. According to the patent, the strips are then connected together by longitudinally extending current carrying ribs of lead metallurgically bonded to and sheathed by the lead infiltrated sintered titanium.

Overlapping member made of said infiltrated sintered metal is a part of the next adjacent strip.

In the present invention lead ribs are not used for strips joining.

U.S. Pat. No. 4,297,421, issued to Turillon et al. on Oct. 27, 1981 discloses a composite electrode constructed from a continuous matrix of titanium infiltrated by lead. The process involves oxidizing the lead in at least part of the external regions of the infiltrated sintered body to provide an electroconductive oxide layer. A volume of the lead dioxide is formed at the surface of each infiltrated path to a predetermined depth. These conducting islands of lead dioxide permit conduction of current between the electrode and the electrolyte. The patent states that the composite electrode can be used for battery grids as well as for electrochemical processes.

The present invention does not provide an oxide layer on the anode's surface when the anodes are manufactured.

U.S. Pat. No. 4,380,493, issued to Wortley et al. on Apr. 19, 1983, relates to a titanium reinforced lead anode for use in electrowinning applications. The anodes claimed in this patent are directed to a plurality of lead or lead alloy rods reinforced with a solid core of titanium or other reinforcing material. The claims require the titanium and lead to comprise separate structural elements, the titanium acting as a core and the lead as a sheath completely covering the surface of the titanium core. The anodes provide a greater tensile strength than the lead or lead alloy alone.

The present invention does not use a plurality of lead or lead alloy rods reinforced by a solid core of titanium. In the present method titanium and lead do not comprise separate structural elements, but are combined into a composite material.

U.S. Pat. No. 4,512,866, issued to Langley on Apr. 23, 1985, relates to anodes which may be used in electrowinning processes. The anodes disclosed are fabricated from a valve metal substrate, such as titanium, a lead or lead alloy antipassivation layer, and a lead ruthenate or lead iridate catalyst in surface contact with the lead or lead alloy layer.

The present invention does not require a lead or lead alloy antipassivation layer, nor a lead ruthenate or lead iridate catalyst.

SUMMARY OF THE INVENTION

Titanium-lead anodes of the present invention may be used for all known electrochemical processes provided in sulfate electrolytes, advantageously, for electrowinning of metals such as copper, zinc, cobalt, etc., and EMD production.

Structure, composition and properties of the anodes may be altered to optimization.

The main initial raw materials are: titanium or titanium alloy powder and lead or lead alloy casting if anodes are produced by immersion of titanium porous compacts into the molten lead bath; titanium or titanium alloy powder and lead or lead alloy powder if the mixture of powders is used to begin the manufacturing of the anodes. Zirconium carbide or titanium carbide powders are used as dopants. Powders of different morphology, particles size and shape may be utilized. Titanium and lead sheets, strips, rods and tubes are acceptable as a core.

Anodes composed from the titanium-lead active layer, or from the titanium-lead active layer covering and the sheet core are produced in the shape of a plate. Anodes composed from the titanium-lead active layer covering and the rod or tube core are produced in the shape of a lattice, wherein a plurality of core elements are covered with strung bushings.

A copper hanger bar may be attached to the plate or lattice by welding or mechanically.

The core made from titanium or lead does not interact with the active layer during the production steps. The titanium or lead core does not dissolve in the sulfate electrolytes, and thus may be completely or partly covered by the active layer. Anodes reinforced by the titanium core are mechanically stronger as compared to the anodes composed of the active layer alone or of the active layer and the lead core. The titanium core also reduces the anode's weight. The lead core has higher electroconductivity and lower cost than the titanium core.

The surface hardness of the active layer is significantly higher, and service life of the anode is longer if zirconium carbide or titanium carbide dopants to the extent of 1 wt % to 10 wt. % are added to the titanium powder or to the mixture of titanium and lead powders. Neither of these compounds interact with titanium or lead during consolidation, sintering or infiltration processes.

Lead on the exterior surface of the anode is not trapped and may dissolve in the electrolyte or flake off. The removal of a portion of lead from the anode surface over the depth of about 5 microns to about 100 microns reduces lead dissolvation in the electrolyte and improves quality of the product and operability of the anode. The surface of the anode may be released from lead chemically by immersion into the nitric acid solution or mechanically by reciprocating motion in the abrasive water suspension, or by wire brushes or any other mechanical treatment.

If the compacts are produced from titanium powder or from titanium powder with carbide dopants, they should be infiltrated with lead. Infiltration is performed by fully or partly immersion into the pure lead bath of 550–700° C. The length of the immersion time (generally, from about 5 to about 30 minutes) should allow to complete the filling of the pores to the desired degree. Without a protective atmosphere, the compacts have to be fully immersed into the lead bath and must not float up to avoid oxidation of titanium. Argon atmosphere, vacuum or additional pressure may be applied. Titanium compacts may be also infiltrated without immersion if placed on or underneath lead casting, and the assembly is heated to the infiltration temperature in the protective atmosphere. This process eliminates the problems associated with molten lead toxicity.

Meaningful manufacturing advantages may be achieved by using the mixture of titanium and lead powders to produce the active layer and thus avoiding the process of immersion into the molten lead bath. Sintering of the powder mixture is provided in a liquid phase of lead, in which the solid titanium particles rearrange. The possible range of active layer composition is wider if it is produced from the mixture of powders, since the active layer can be constructed of any desired mixture of titanium and lead.

The content of titanium or lead in powder and cast form in the anode may vary from 1 wt % to 99 wt %.

Both plate and lattice anodes may be sufficiently used for metal electrowinning processes, such as cathode deposition of copper, zinc or cobalt.

If intended to be used for EMD production, when a pneumatic hammer is used to remove the product, anodes should possess high mechanical strength. In such circumstances, it is preferable to use lattice anodes with the titanium rod core. The plate anodes may be used as well as lattice anodes for manganese dioxide production in case the product is generated as a precipitate at the bottom of the cell.

OBJECTS OF THE INVENTION

A general object of this invention is to provide a full scale insoluble titanium-lead anode for electrowinning of metals and/or EMD production with longer service life, higher mechanical strength, lower weight, improved operability under extended range of electrolysis parameters, and higher quality of the product in combination with reduced cost of the electrolysis over what is shown in the prior art.

Another general object of this invention is to provide an improved manufacturing process for production full scale titanium-lead anodes with composition, generally, from 1 to 99% of titanium or titanium alloy and the remainder lead or lead alloy.

A further object of this invention is to provide a titanium-lead plate anode composed of the titanium-lead active layer and a welded copper hanger bar with a titanium covering wherein the titanium covering insures a strong joint and a high quality of the electrical contact.

A further object of this invention is to provide a titanium-lead plate anode with an increased mechanical strength and reduced weight wherein the plate is composed of the titanium-lead active layer and a titanium sheet core.

A further object of this invention is to provide a titanium-lead plate anode with an increased electroconductivity, wherein the plate is composed of the titanium-lead active layer and a lead sheet core.

A further object of this invention is to provide a titanium-lead plate anode with improved uniformity of the composition and structure wherein the titanium-lead plate is formed of two or more strips, joined to each other by welding or mechanically, and/or by attachment to a hanger bar.

A further object of this invention is to provide a titanium-lead plate anode composed of the titanium-lead plate and a mechanically attached copper hanger bar wherein the mechanical joining increases the strength of the anode.

A further object of this invention is to provide a titanium-lead lattice anode with increased mechanical strength and reduced weight wherein the lattice is composed of the titanium-lead active layer in the shape of round bushings strung on the titanium rod or tube core.

A further object of this invention is to provide a titanium-lead lattice anode with increased electroconductivity w herein the titanium-lead round bushings are strung on the lead rod core.

A further object of this invention is to provide a titanium-lead lattice anode with increased surface area wherein the titanium-lead pinions are strung on the titanium or the lead core.

A further object of this invention is to provide a titanium-lead plate and/or lattice anode with increased hardness of the surface wherein the titanium-lead active layer is dispersion-strengthened by zirconium carbide or titanium carbide dopants.

A further object of this invention is to provide a titanium-lead plate and/or lattice anode with improved operability and increased quality of the product wherein the titanium-lead active layer is released of a portion of lead from the surface.

A further object of this invention is to provide a manufacturing method for production of titanium-lead plate and/or lattice anode using a process of immersion of titanium porous compacts into the molten lead bath.

A further object of this invention is to provide a manufacturing method for production of titanium-lead plate and/or lattice anode using a mixture of titanium and lead powders to begin the production.

DESCRIPTION OF THE INVENTION

Plate Anodes

Figure 1:
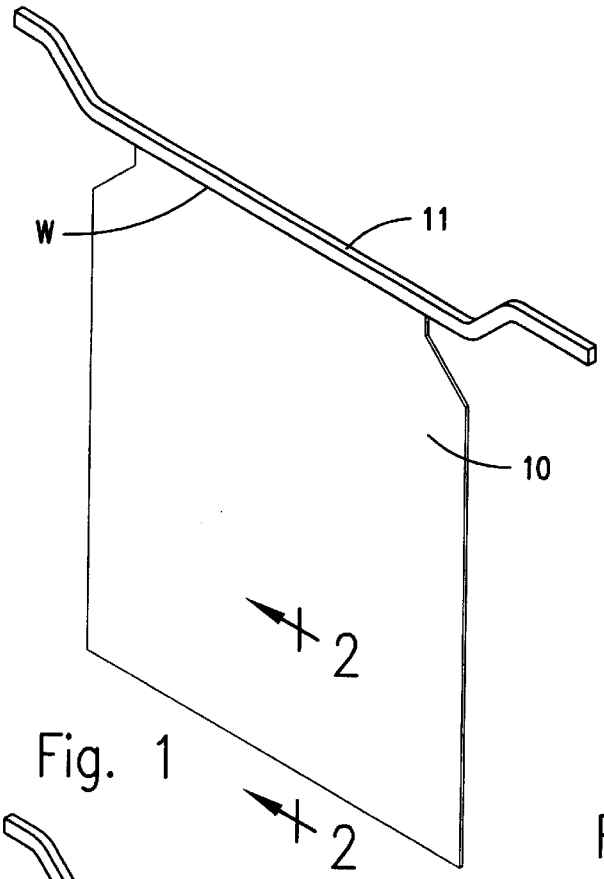
FIG. 1 is a perspective view of a plate anode with a welded hanger bar.

Alternative variations of plate anodes of the present invention are depicted in FIGS. 1 to 5. FIG. 1 shows the plate anode composed of the plate 10, made from the titanium-lead active layer, and a welded copper hanger bar 11. The copper hanger bar 11 has to be initially covered with titanium to be welded to the plate 10. The titanium covering improves the quality of the resistance weld W and provides an excellent electrical contact. It is preferable to weld the hanger bar to the titanium plate before infiltration with lead to avoid lead smoke during the welding to the infiltrated plate. When the porous titanium plate with the hanger bar is immersed into the lead bath, the titanium covering protects copper from interaction with the molten lead.

Figure 2:
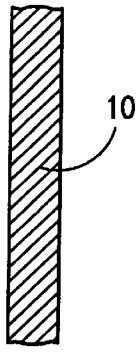
FIG. 2 is a cross-section along line 2—2 in FIG. 1 showing a plate anode without a core.
Figure 2A:
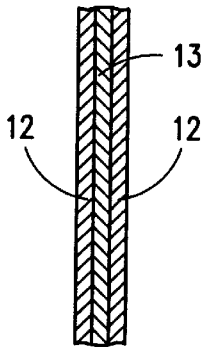
FIG. 2*a* is a cross-section like FIG. 2, but showing a variation of a plate anode with a core.

In manufacturing plate anodes for purposes of the present invention, consolidation of the titanium powder or the mixture of titanium and lead powders (when desired, with titanium carbide or zirconium carbide dopants) is performed either by cold or hot pressing or/and by cold or hot rolling. Hot vacuum pressing is preferable. A set of plates may be pressed simultaneously. Cold consolidation is followed by sintering. Loose-powder sintering is possible. After hot consolidation no sintering is necessary. The same manufacturing processes are used to produce the plate 10 from the titanium-lead active layer alone (see FIG. 2), and from the titanium-lead active layer covering 12 and the titanium or lead sheet core 13 (see FIG. 2*a*). The thickness of the active layer covering, generally, is from 0.1 to 1.0 times the thickness of the core. In the case of plate anodes with the titanium core, plasma covering of the core by the titanium powder, or the mixture of titanium and lead powders may be used along with cold or hot pressing or rolling. Hot consolidation and lead infiltration may be combined into one process if lead is used as a core.

Figure 3:
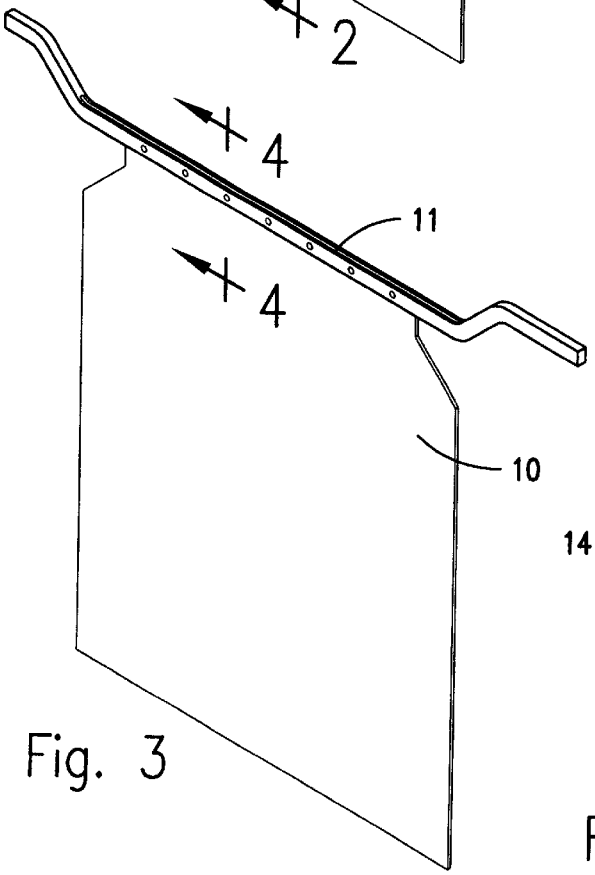
FIG. 3 is a perspective view of a plate anode with an attached mechanically hanger bar.
Figure 4:
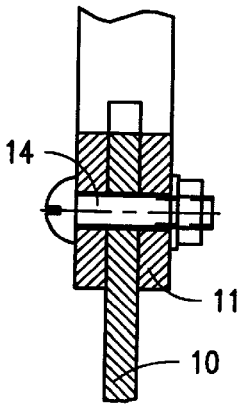
FIG. 4 is a cross-section along line 4—4 in FIG. 3 showing a mechanical attachment of a hanger bar by bolt joint.
Figure 4A:
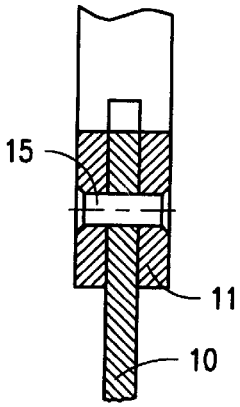
FIG. 4*a* is a cross-section like FIG. 4, but showing a variation of mechanical attachment of a hanger bar by riveted joint.

FIG. 3 is an illustration of the plate anode composed of the plate 10 and the copper hanger bar 11 attached mechanically. Two variations of the mechanical joining of the plate 10 to the copper hanger bar 11 by titanium or stainless steel bolts 14 and by rivets 15 are shown in FIG. 4 and FIG. 4*a* respectively. In addition to depicted in the drawing, other equivalent options of the hanger bar attachment can be employed. No titanium covering of the copper hanger bar is necessary if it is attached mechanically. Mechanical joining of the copper hanger bar to the plate may be performed before or after infiltration. In case the hanger bar is attached to porous titanium plate before infiltration, lead fills all spaces between the plate 10 and the hanger bar 11. Usage of the mechanical joining eliminates stresses at the top portion of the plate, which are usually caused by welding, and thus increases the strength of the anode. If a titanium hanger bar is used, it might be attached to the plate directly during the consolidation process.

Figure 5:
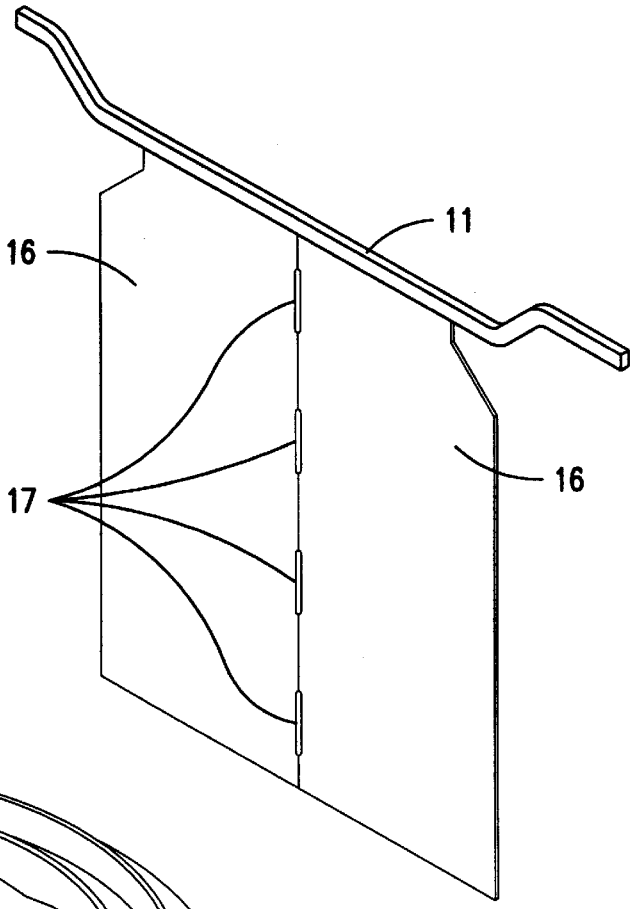
FIG. 5 is a perspective view of a plate anode formed of two strips joined by welding.

If preferable, the plate anode may consist of two or more strips. The strips may be joined before or after infiltration by welding or mechanically, and additionally by a hanger bar, or by a hanger bar alone. FIG. 5 illustrates a variation of a plate anode produced from two strips 16, which are joined by welding 17 to each other and by a welded hanger bar 11. Anodes made of the joined strips have essentially uniform composition and structure.

Figure 6:
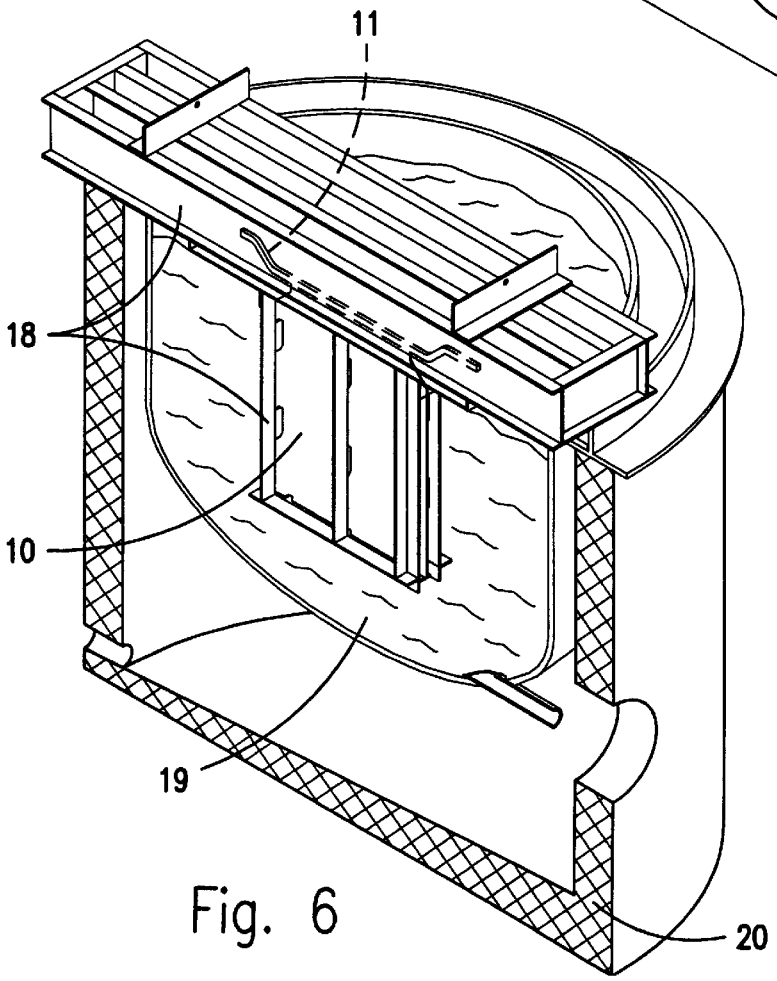
FIG. 6 is a cut-away view of a kettle setting showing a plate anode in a frame, immersed in the molten lead bath.

FIG. 6 of the drawing is a variation of a kettle setting showing a plate 10 with a hanger bar 11 in a frame 18 while immersed into the molten lead bath 19 in the kettle 20. Alternative kettle settings and frames can also be used for the purposes of the present invention. The porous titanium plate or set of plates may be immersed into the lead bath in vertical or horizontal orientation.

To provide adequate spacing between electrodes and to operate satisfactorily in the electrowinning tank, the plate anodes should have the flatness tolerance in a range ±0.125". During the infiltration and cooling, warpage of the straight porous plate may occur, particularly, if hanger bar was attached to the plate before infiltration. Several manufacturing steps may be employed to prevent bending of the plate and to provide the required flatness of the anode. A fixed steel frame 18 can be used to keep the plate flat, as it is shown in FIG. 6. To eliminate the distortion, the plate 10 with the attached hanger bar 11 may be dipped into the molten lead to hanger bar, keeping the hanger bar above the lead bath. After removing from the lead bath, the anode may be placed horizontally between two steel plates to cool under pressure. It is preferable to infiltrate the plate in a lead bath of high temperature (600–700° C.) for as less length of time as is enough (usually, from 5 to 15 min) to obtain the desirable filling the pores with lead (more than 75–80%). If the protective atmosphere is used, the porous plate can be heated to the infiltration temperature prior to immersion and immersed fully or partly into the molten lead, or can be infiltrated without immersion.

The fast cooling of the infiltrated plate is helpful to prevent the lead drain effect and to improve uniformity of the anode. After immersion, the infiltrated plates may be cooled by compressed air. To eliminate lead dripping in case of high porosity plates, it is preferable to use fine titanium powders to reduce the size of pores. To produce low porosity plates titanium powders of any sizes may be employed.

Plate Anode Embodiments

In the preferred embodiment, the titanium powder is hot pressed forming a titanium porous plate. Next a copper hanger bar with a titanium covering is attached to the plate by welding. Then the porous plate is dipped into a molten lead bath thereby being infiltrated with lead, keeping the attached hanger bar above the bath. The infiltrated plate is then pulled out of the bath and placed between two steel plates to cool. Next in the cleaning operation, the excess lead is removed from the surface of the plate. Then the plate anode is placed in use in an electrolysis cell.

In a second embodiment, the titanium powder is hot pressed as in the first embodiment, and the resultant titanium plate is placed in a bath of molten lead, and then pulled out of the bath and cooled. At this point a hanger bar is attached mechanically, and next the excess lead is cleaned off.

In a third embodiment, hot pressing of the titanium powder on both sides of a titanium core is done to form a plate having a core. Then the hanger bar is attached to the plate. Next the plate is infiltrated with lead and cleaned. In a forth embodiment, after hot pressing of the plate from the titanium powder with a titanium core, infiltration of the plate with lead occurs followed by attachment of the hanger bar and then cleaning the plate.

In a fifth embodiment the plate is hot pressed from the titanium powder with a lead core. Hot pressing of the plate and infiltration with lead are combined into one operation. Then attachment of the hanger bar and cleaning follows.

In the next, or sixth, embodiment hot pressing of the mixture of the titanium and lead powders occurs to begin production. Hot pressing of the plate is followed by the attachment of the hanger bar and cleaning.

The seventh embodiment consists of hot pressing of the plate from the mixture of titanium and lead powders with a titanium core and then attaching the hanger bar and subsequent cleaning.

The eighth embodiment consists of pressing of the plate from the mixture of titanium and lead powders with a lead core and then attachment of the hanger bar and cleaning.

Along with hot pressing, the alternate processes of consolidation can be employed, for example, hot rolling; cold rolling or cold pressing and following sintering, etc. Infiltration of the porous plates may be also performed by alternate methods, without immersion into the molten lead bath. Cleaning and attachment of the hanger bar steps might be reversed.

Thus, it can be seen, when referring to eight embodiments involving plate anodes, they comprise four general processes to begin the manufacturing; namely, 1. Consolidation of the titanium powder to make a plate of definitive size and structure.

2. Consolidation of the titanium powder on a titanium or lead core.

3. Consolidation of the mixture of titanium and lead powders; or lastly

4. Consolidation of the mixture of titanium and lead powders on a titanium or lead core.

Lattice Anodes

Figure 8:
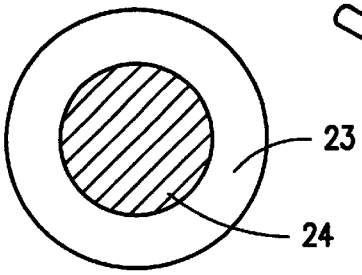
FIG. 8 is a cross-section along line 8—8 in FIG. 7 showing a lattice anode with a rod core.
Figure 8A:
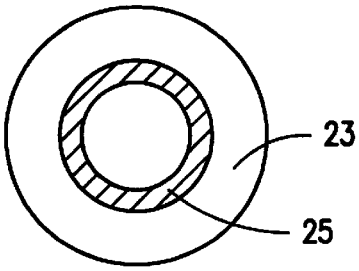
FIG. 8*a* is a cross-section like FIG. 8, but showing a variation of a lattice anode with a tube core.
Figure 7:
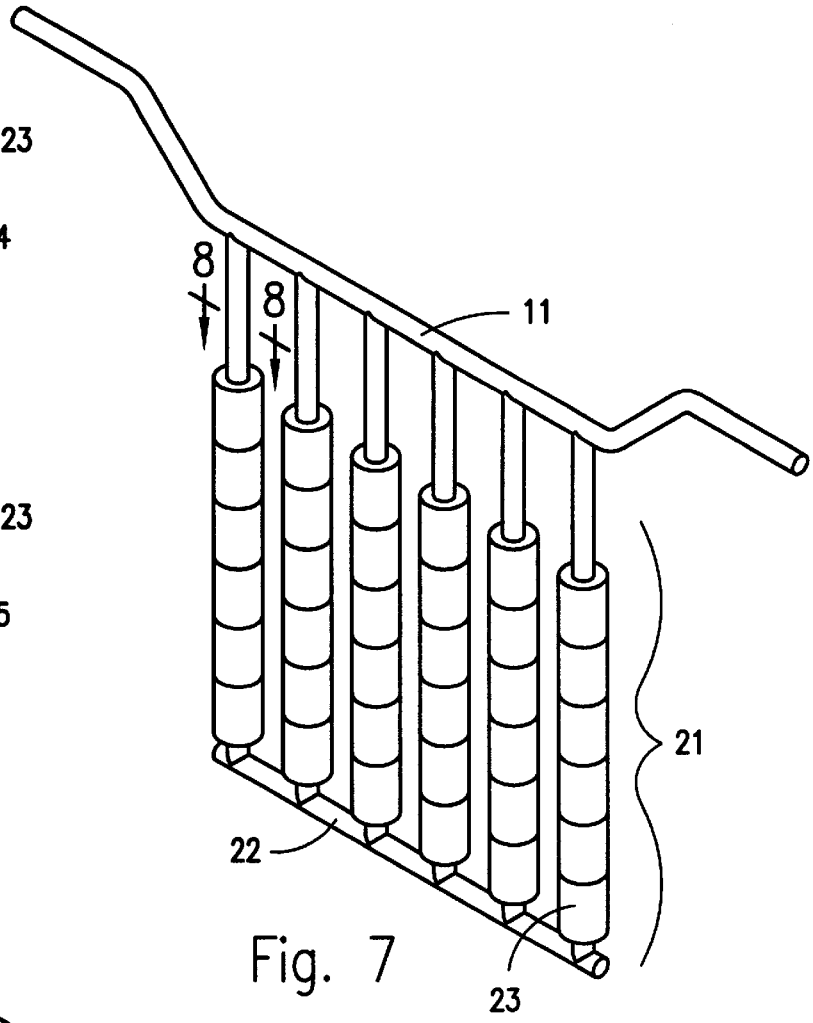
FIG. 7 is a perspective view of a lattice anode with round bushings.
Figure 9:
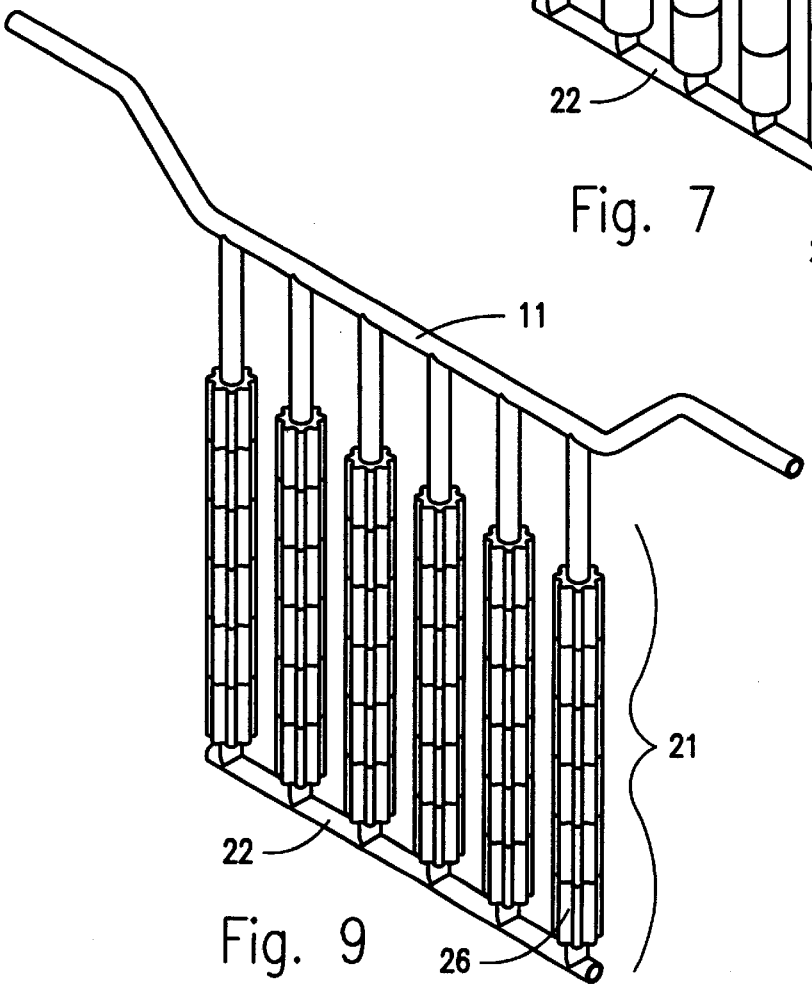
FIG. 9 is a perspective view of a lattice anode with pinions.

Variations of lattice anodes of the present invention are shown in FIGS. 7, 8, 8*a* and 9. FIG. 7 is a perspective view of a lattice anode formed of the strings 21, which are rigidly attached to the connecting bar 22 and connecting hanger bar 11. Strings 21 are composed of the titanium-lead bushings 23 strung on the rod core 24 or tube core 25, as illustrated by FIGS. 8 and 8*a* respectively. The titanium-lead bushings and the core, made from titanium or lead, may have different sizes and shapes. The bushings preferably have an internal diameter of 1.005–1.070 times the external diameter of the core and a thickness of 0.1–1.0 times the external diameter of the core. The length of the bushings is limited only by the length of the core. Along with round bushings 23, pinions or other shapes of bushings may be used to increase the active surface of the lattice anode. A variation of a lattice anode with pinions 26 is shown in FIG. 9.

The initial step to manufacture lattice anodes is to produce the bushings. Consolidation of the bushings from titanium powder, or the mixture of titanium and lead powders (if desired, with titanium carbide or zirconium carbide additives) is performed by cold or hot uniaxial or isostatic pressing, or extrusion. Sintering of the compacts is provided after cold consolidation.

Stringing of the bushings on the core is carried out with a gap of about 0.05–0.50 mm between the internal surface of the bushings and the core. The bushings may be strung on the titanium core either after consolidation, or after sintering, or after infiltration, or after cleaning the surface from lead. If bushings are strung after cold consolidation and then sintered on the titanium core, the diffusion bond is formed between the bushings and the core due to shrinkage of the bushings. In case of providing infiltration after stringing, along with filling the pores, lead also fills the spaces between the bushings and between the bushings and the core. No sintering or infiltration should occur after stringing of the bushings on the lead core. Soldering may be used to improve the electrical contact between the bushings and the core.

Alternatively, strings may be produced by forming the titanium-lead covering directly on the core using cold or hot consolidation of the titanium powder or the mixture of titanium and lead powders. Strings may be also formed from the titanium-lead active layer without a core.

A plurality of strings may be joined into the lattice before and after sintering, or before and after infiltration, or before and after cleaning. Sizes and amount of strings in the lattice may alter. In case a layer of the product has to be deposited on the anode, appropriate spaces between the strings are needed. If necessary, the damaged elements of the lattice anode may be easily replaced.

Lattice Anode Embodiments

A preferred embodiment is cold pressing of the bushings from the titanium powder, stringing of the bushings on the titanium core, sintering of the strings with bond formation between the bushings and the core, infiltration of the strings with lead, attachment of the strings to the connecting bars (formation of the lattice) and cleaning. Then the lattice anode is placed in use in an electrolysis cell.

A second embodiment is cold pressing of the bushings from the titanium powder, stringing of the bushings on the titanium core, sintering of the strings with bond formation between the bushings and the core, attachment of the strings to the connecting bars, infiltration of the formed lattice with lead and cleaning.

A third embodiment is cold pressing of the bushings from the titanium powder, stringing of the bushings on the titanium core, attachment of the strings to the connecting bars, sintering of the lattice and bond formation between the bushings and the core, infiltration of the lattice with lead and cleaning.

A fourth embodiment is cold pressing of the bushings from the titanium powder, sintering of the bushings, stringing of the bushings on the titanium core, infiltration of the strings with lead (filling the pores and the gaps between the bushings and the core), attachment of the strings to the connecting bars and cleaning.

A fifth embodiment is cold pressing of the bushings from the titanium powder, sintering of the bushings, stringing of the bushings on the titanium core, attachment of the strings to the connecting bars, infiltration of the lattice with lead (filling the pores and the gaps between the bushings and the core) and cleaning.

A sixth embodiment is cold pressing of the bushings from the titanium powder, sintering of the bushings, infiltration of the bushings with lead, stringing of the bushings on the titanium or lead core, attachment of the strings to the connecting bars and cleaning.

A seventh embodiment is cold pressing of the bushings from the mixture of titanium and lead powders, stringing of the bushings on the titanium core, liquid-phase sintering of the strings with bond formation between the bushings and the core, attachment of the strings to the connecting bars and cleaning.

An eighth embodiment is cold pressing of the bushings from the mixture of titanium and lead powders, stringing of the bushings on the titanium core, attachment of the strings to the connecting bars, liquid-phase sintering of the lattice with bond formation between the bushings and the core and cleaning of the lattice. A ninth embodiment is cold pressing of the bushings from the mixture of titanium and lead powders, liquid-phase sintering of the bushings, stringing of the bushings on the titanium or lead core, attachment of the strings to the connecting bars and cleaning.

Along with cold pressing of the bushings, alternate means to begin the production of lattice anodes can be used, such as hot pressing, extrusion, etc. The cleaning step my be done before and after stringing of the bushings on the core, or before and after attachment of the strings to the connecting bars.

Thus, the nine embodiments involving lattice anodes comprise the following general processes to begin the manufacturing:

1. Cold or hot consolidation of the bushings from the titanium powder and stringing of the bushings on the titanium core.

2. Hot consolidation of the bushings from the titanium powder, infiltration of the bushings with lead and stringing of the bushings on the titanium or lead core.

3. Cold or hot consolidation of the bushings from the mixture of titanium and lead powders and stringing of the bushings on the titanium core.

4. Hot consolidation of the bushings from the mixture of titanium and lead powders and stringing of the bushings on the lead core.

Examples of Manufacturing of Anodes for Copper Electrowinning

1. A titanium plate with sizes 1140×915 mm, thickness 6 mm and porosity 50% was produced from titanium powder PT 4 (particle size >0.315 to <0.630 mm) by hot pressing under vacuum at 1100° C. in a graphite die. After that a copper hanger bar with titanium covering was attached to the titanium porous plate by welding. The titanium plate was placed into a frame and dipped to hanger bar into a molten lead bath of 600° C. for 10 minutes. The infiltrated plate was pulled from the frame and laid flat to cool on a steel plate, and a second steel plate was placed on the top. Then the surface of the plate was released from lead by wire brushes. The anode was constructed from the titanium-lead active layer. The composition of the active layer was 32 wt % Ti and 68 wt % Pb.
2. Two titanium strips with sizes 1170×460 mm, thickness 6 mm and porosity 30% were produced from titanium powder PT 3 (particle size >0.18 to <1.00 mm) with ZrC dopants by cold rolling and following sintering in the dry argon atmosphere of 1100° C. for 1 hour. Two co-planar strips were joined by welding. After that the plate was welded to a copper hanger bar with a titanium covering, then infiltrated by immersion in a lead bath of 650° C. for 10 min and placed to cool under pressure between two steel plates. The surface of the anode was released from lead by an abrasive water suspension. The anode was constructed from the dispersion-strengthened titanium-lead active layer. The composition of the active layer was 51.0 wt % Ti, 2.0 wt % ZrC and 47.0 wt % Pb.
3. A titanium plate with sizes 1170×915 mm, thickness 6 mm and porosity 40% was produced from titanium powder PT 4 with TiC dopants by hot pressing under vacuum at 1200° C. in a graphite die. The porous plate was placed on the top of lead alloy casting, and the assembly was heated under a neutral atmosphere to 600° C. and cooled. After that a copper hanger bar was mechanically attached to the infiltrated plate using titanium bolts. The surface of the plate was released from lead by an abrasive water suspension. The anode was constructed from the dispersion-strengthened titanium-lead active layer. The composition of the active layer was 39 wt % Ti, 1 wt % TiC and 60 wt % Pb—Ca—Sn.
4. A plate with sizes 1140×915 mm and thickness 8 mm was produced by hot pressing of titanium alloy powder, placed on both sides of a titanium core, under vacuum at 1100° C. in a graphite die. The thickness of the core was 3 mm. The porosity of the titanium covering was 50%. The plate was dipped into a lead bath of 650° C. for 15 min. The infiltrated plate was cooled by compressed air. A hanger bar was attached to the plate by welding. The surface of the plate was released from lead by immersion into 10% nitric acid for 5 min. The anode was constructed from the titanium sheet core and active layer covering. The composition of the active layer covering was 30.5 wt % Ti-6Al-4V and 69.5 wt % Pb.
5. A titanium-lead plate with sizes 1170×915 mm and thickness 6 mm was produced by hot pressing of the mixture of titanium and lead powders under the dry argon atmosphere of 1000° C. The surface of the plate was cleaned by wire brushes. A hanger bar was attached to the plate by titanium riveted joints. The anode was constructed from the titanium-lead active layer. The composition of the active layer was 40 wt % Ti and 60 wt % Pb.
6. A plate with sizes 1140×915 mm and thickness 8 mm was produced by hot pressing of the mixture of titanium and lead powders, placed on both sides of a lead core, under dry argon atmosphere of 900° C. The thickness of the core was 3 mm. A hanger bar was attached to the plate by welding. The surface of the plate was cleaned by wire brushes. The anode was constructed from the lead sheet core and the titanium-lead active layer covering. The composition of the active layer covering was 15 wt % Ti and 85 wt % Pb.
7. Bushings with the internal diameter 10.2 mm, thickness 3 mm, length 40 mm and porosity 25% were produced from titanium powder PT 2 (particle size >0.63 to <1.00 mm) by closed die uniaxial compaction at compacting pressure 8,000 kg/cm$^2$. Covering of the titanium tube core (length 1140 mm and external diameter 10.0 mm) was performed by the following: stringing of the bushings on the core; vacuum sintering of the strings at 1200° C. for 1.5 hour with diffusion bond formation between the bushings and the core due to shrinkage of the bushings; infiltration of the strung bushings by immersion of the strings in a lead bath of 650° C. for 10 min: cleaning of the strings by an abrasive water suspension. Forty strings were rigidly attached to the titanium connecting bar and the hanger bar by welding. The lattice anode was constructed from the titanium tube core and the titanium-lead active layer covering. The composition of the active layer was 70 wt % Ti and 30 wt % Pb.

Anodes were tested upon the following operation conditions of the copper electrowinning:

| | |
|---|---|
| Material of cathodes | Copper, Stainless steel |
| Electrolyte composition | 20–55 g/l Cu<br>100–170 g/l $H_2SO_4$ |
| Temperature | 30–70° C. |
| Anode current density | 160–650 A/m$^2$ |

The advantages of the anodes of the present invention over conventional lead alloy anodes are as follows:

Life of the anodes is evaluated as 10–12 years, which is two-three times longer than lead alloy anodes.

Anodes operate at higher current densities and lower voltage.

Anodes have higher structural integrity and lower weight.

Anodes are dimensionally stable and maintenance free.

Plated copper deposits are smooth and uniform. The lead content in the product is ten times lower if compared to lead alloy anodes.

Cobalt dopants are not required to be added to the electrolyte, which essentially reduces the cost of the electrowinning process.

Example of manufacturing of anodes for EMD production

Bushings with the internal diameter 19.8 mm, thickness 5 mm, length 60 mm and porosity 30% were produced from titanium powder PT 3 with ZrC dopants by closed die uniaxial compaction at compacting pressure 5,000 kg/cm$^2$ and sintering under dry argon atmosphere of 1100° C. for 1 hour. Covering of the titanium rod core (length 2 m and diameter 19.7 mm) was performed by the following: stringing of the bushings on the core; infiltration of the bushings and filling the gaps between the bushings and the core by immersion of the strings in a lead bath of 650° C. for 15 min; cleaning of the strings by an abrasive water suspension. Thirty strings were rigidly attached to the titanium connecting bar and the hanger bar by welding. The lattice anode was constructed from the titanium rod core and the dispersion-strengthened titanium-lead active layer. The composition of the active layer was 46 wt % Ti, 6 wt % ZrC and 48 wt % Pb.

Anodes were tested upon following operation conditions of EMD production:

| | |
|---|---|
| Material of cathodes | electrographite, stainless steel |
| Electrolyte composition | 5–150 g/l $H_2SO_4$<br>20–200 g/l $MnSO_4$ |
| Temperature | 40–100° C. |
| Anode current density | 50–250 A/m$^2$ |
| EMD layer thickness | 5–30 mm |
| Method of product removing | an air-operated hammer |

EMD deposit was plated on the anode. After the end of each electrolysis cycle, deposit was stripped from the anode by a hammer, and the next cycle was conducted.

Anodes are capable to operate in EMD production under wide range of electrolysis parameters, such as sulfuric acid concentration, operating current density, electrolyte temperature. Elevated current density results in increased productivity of electrolysis. Contamination of EMD with products of anode corrosion is practically eliminated. The high mechanical strength of anodes allows to remove the product by pneumatic impact treatment. Service life of the anodes is evaluated as 15–20 years. EMD output by substance is 98.0–99.5%.

The specification is not be limited to specific details as described above and can have a larger scope of the invention, it being appreciated that changes can be made and still be included in the scope of the invention.

What is claimed is:

1. An insoluble titanium-lead anode comprising an anode structure including powder means and cast means and having, generally, from 1 to 99 wt % titanium and the remainder lead, wherein said anode structure is a titanium-lead plate with a flatness tolerance in a range ±0.125", and a hanger bar being attached to said plate.

2. An insoluble anode as in claim 1 wherein said titanium-lead plate comprises the titanium-lead active layer.

3. The process of manufacturing anodes recited in claim 2 including the steps of consolidation of the titanium powder making a predetermined titanium porous plate, sintering, infiltration with lead, cleaning the surface of the anode structure of lead and attachment of the hanger bar.

4. The process of manufacturing anodes as in claim 3 wherein said titanium porous plate is made by hot consolidation.

5. The process of manufacturing anodes as in claim 3 wherein said titanium porous plate is made by cold consolidation and following sintering.

6. The process of manufacturing anodes as in claim 3 wherein said attachment of the hanger bar is made before said infiltration of the titanium porous plate with lead.

7. The process of manufacturing anodes as in claim 6 wherein said infiltration of titanium porous plate with said hanger bar attached is provided by immersion into the molten lead bath keeping the hanger bar above the bath.

8. The process of manufacturing anodes as in claim 6 wherein said infiltration of titanium porous plate with said hanger bar attached is provided by immersion into the molten lead bath keeping the hanger bar inside the bath.

9. The process of manufacturing anodes as in claim 3 wherein said attachment of the hanger bar is made after said infiltration of the titanium porous plate with lead.

10. The process of manufacturing anodes as in claim 3 wherein a fixed steel frame is used for immersion of said titanium porous plate into the molten lead bath.

11. The process of manufacturing anodes as in claim 3 wherein after infiltration the titanium-lead plate is placed horizontally between two steel plates to cool under pressure.

12. The process of manufacturing anodes as in claim 3 wherein the infiltration is performed by placing said titanium porous plate on the lead casting and heating the assembly to the infiltration temperature in the protective atmosphere.

13. The process of manufacturing anodes recited in claim 2 including the steps of consolidation of the mixture of titanium and lead powders, liquid phase sintering, cleaning the surface of the anode structure of lead and attachment of the hanger bar.

14. An insoluble titanium-lead anode comprising an anode structure including powder means and cast means and having, generally, from 1 to 99 wt % titanium and the remainder lead, wherein said anode structure is a titanium-lead lattice comprising a plurality of attached to connecting bars strings having the titanium-lead active layer covering and a rod core and being made from bushings which are strung on said core.

15. The process of manufacturing anodes recited in claim 14 wherein said bushings are produced by consolidation of titanium powder.

16. The process of manufacturing anodes recited in claim 14 wherein said bushings are produced by consolidation of titanium powder and sintering.

17. The process of manufacturing anodes recited in claim 14 wherein said bushings are produced by consolidation of titanium powder, sintering and infiltration with lead.

18. The process of manufacturing anodes recited in claim 14 wherein said bushings are produced by consolidation of the mixture of titanium and lead powders.

19. The process of manufacturing anodes recited in claim 14 wherein said strings are produced by stringing of said bushings on said core, sintering and infiltration with lead.

20. The process of manufacturing anodes recited in claim 14 wherein said strings are produced by stringing of said bushings on said core and sintering.

21. The process of manufacturing anodes recited in claim 14 wherein said strings are produced by stringing of said bushings on said core.

22. The process of manufacturing anodes recited in claim 14 wherein said strings are produced by stringing of said bushings on said core and infiltration with lead.

23. The process of manufacturing anodes recited in claim 14 wherein said lattice is made by attachment of said strings to said connecting bars and cleaning the surface of the anode structure of lead.

24. The process of manufacturing anodes recited in claim 14 wherein said lattice is made by attachment of said strings to said connecting bars, infiltration with lead and cleaning the surface of the anode structure of lead.

25. The process of manufacturing anodes recited in claim 14 wherein said lattice is made by attachment of said strings to said connecting bars, sintering, infiltration with lead and cleaning the surface of the anode structure of lead.

26. The process of manufacturing anodes recited in claim 14 wherein a diffusion bond is formed between said bushings and said core.

27. The process of manufacturing anodes recited in claim 14 wherein the spaces between said bushings and said core being filled with lead.

* * * * *

UNITED STATES PATENT AND TRADEMARK OFFICE

CERTIFICATE OF CORRECTION

PATENT NO. : 6,287,433 B1
DATED : September 11, 2001
INVENTOR(S) : Alla Sapozhnikova It is certified that error appears in the above-identified patent and that said Letters Patent is hereby corrected as shown below:

Title page,
Item [76], delete "Alla Sapozhnikova" and replace with -- Alla Ferdman --.

Signed and Sealed this

Twelfth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,287,433 B1
DATED : September 11, 2001
INVENTOR(S) : Alla Ferdman

It is certified that error appears in the above-identified patent and that said Letters Patent is hereby corrected as shown below:

Title page,
Item [76], delete "Alla Sapozhnikova" and replace with -- Alla Ferdman --

Signed and Sealed this

Sixth Day of August, 2002

*Attest:*

*Attesting Officer*

JAMES E. ROGAN
*Director of the United States Patent and Trademark Office*